US006021304A

United States Patent [19]

Sbert et al.

[11] Patent Number: 6,021,304

[45] Date of Patent: Feb. 1, 2000

[54] LOW FRICTION, CONDUCTIVE SPOTS BLADE

[75] Inventors: Robert C. Sbert, Rochester; Douglas A. Lundy, Webster; Norman L. Roof, Jr., Palmyra, all of N.Y.

[73] Assignee: Xerox Corporation, Stamford, Conn.

[21] Appl. No.: 09/182,620

[22] Filed: Oct. 29, 1998

[51] Int. Cl.[7] ..... G03G 21/00

[52] U.S. Cl. ..... 399/349; 399/350

[58] Field of Search ..... 399/349, 350, 399/351; 15/256.5, 256.51, 1.51

[56] References Cited

U.S. PATENT DOCUMENTS

| | | | |
|---|---|---|---|
| 4,252,433 | 2/1981 | Sullivan | 399/350 |
| 5,138,395 | 8/1992 | Lindblad et al. | 399/350 |
| 5,659,849 | 8/1997 | Lindblad et al. | 399/350 |

*Primary Examiner*—Matthew S. Smith
*Assistant Examiner*—William A. Noe
*Attorney, Agent, or Firm*—Kevin R. Kepner

[57] ABSTRACT

A cleaning apparatus having a spots cleaning blade to remove residual agglomerations of particles from the imaging surface. The spots cleaning blade is made from a material that has a low coefficient of friction, low resilience and higher hardness than a standard spots blade. These properties enable the spots cleaning blade to provide a continuous slidable contact with the imaging surface to remove residual particles therefrom. Additionally, an electrically conductive surface can be added to the front or back surface of the blade to cause toner particles to be repelled from and cloud near the blade where they can be removed by a vacuum device or the like. The conductive surface may be direct negative, direct positive or A-C potential to provide the necessary repelling force.

11 Claims, 5 Drawing Sheets

LOW FRICTION, CONDUCTIVE SPOTS BLADE

This invention relates generally to an electrostatographic printer and copier, and more particularly, concerns a cleaning apparatus for removal of residual particles and agglomerates from the imaging surface.

In an electrophotographic application such as xerography, a charge retentive surface is electrostatically charged, and exposed to a light pattern of an original image to be reproduced to selectively discharge the surface in accordance therewith. The resulting pattern of charged and discharged areas on that surface from an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways. Ion projection devices, where a charge is imagewise deposited on a charge retentive substrate, operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive or insulative fiber bristles. While the bristles are soft they are sufficiently firm to remove residual toner particles from the charge retentive surface. A voltage is applied to the fibers to enhance removal of toner from the charge retentive surface.

Not all toner and debris is removed from the surface by the brush cleaner. For reasons that are unclear, toner particles agglomerate with themselves and with certain types of debris to form a spot-wise deposition that can eventually strongly adhere to the charge retentive surface. These spots range from 50 micrometers to greater than 400 micrometers in diameter and 5 to 25 micrometers in thickness, but typically are about 200 micrometers in diameter and 5 to 15 micrometers in thickness. The agglomerates range in material compositions from nothing but toner to a broad assortment of plastics and debris from paper. The spots cause a copy quality defect showing up as a black spot on a background area of the copy which is the same size as the spot on the photoreceptor. The spot on the copy varies slightly with the exact machine operating conditions, but cannot be deleted by controlling the machine process controls.

Attempts to eliminate the agglomerate spotting by controlling of extraneous debris have been found difficult if not impossible to implement. Additionally, there was no way to eliminate the formation of agglomerates that the toner formed itself. However, in studying the formation of these spots, it was noted that the spots appeared instantaneously on the charge retentive surface, i.e., the spots were not the result of a continuing nucleation process. It was subsequently noted that newer deposited spots were more weakly adhered to the surface than older spots.

Several copier products commonly use a urethane blade material (e.g. 107-5, supplied by Acushnet) for a spots blade. The spots blade is positioned, after the cleaning station, to remove agglomerations and debris from the photoreceptor. The use of a spots blade as a secondary cleaner for these products has been shown to be very effective in removing debris that can cause a spot defect on the copy. However, many of the spots blades presently used have the disadvantage of high friction between the blade and the photoreceptor. This causes the spots blade to intermittently stick to the photoreceptor surface creating a type of bouncing or skipping action of the spots blade as it rides on the photoreceptor. This bouncing or skipping action can cause copy quality defects. Furthermore, spots blades that exhibit high friction can foldover when placed in pressure contact with the photoreceptor. When failure due to foldover occurs, the blade must be replaced. Additionally, some of the spots blades tend to attract toner particles that have been loosened from the photoreceptor surface and then pass under the blade. These toner particles sometimes accumulate on the backside of the cleaning blade and can be shaken loose from the blade when the blade contacts the photoreceptor seam. These particles can then produce a defect known as lead edge splatter.

There is also an application in which magnetic toner is utilized for printing documents such as checks for which a magnetic character reader is used to process the document. The use of this toner, referred to as a "MICR" printer, contributes even further to the toner shake-off problem due to the toner being heavier because of the increased content of magnetite.

The following disclosures may be relevant to various aspects of the present invention and may be briefly summarized as follows:

U.S. Pat. No. 5,339,149 to Lindblad et al discloses a cleaning apparatus having a spots cleaning blade to remove residual agglomerations of particles from the imaging surface. The spots cleaning blade is made from a material that has a low coefficient of friction, low resilience and higher hardness than a standard spots blade. These properties enable the spots cleaning blade to provide a continuous slidable contact with the imaging surface to remove residual particles therefrom.

U.S. Pat. No. 4,989,047 to Jugle et al. discloses a cleaning apparatus for an electrophotographic printer that reduces agglomeration-caused spotting on the imaging surface. A secondary cleaning member, characterized as a thin scraper blade, is arranged at a low angle of attack, with respect to the imaging surface, to allow a maximum shearing force to be applied by the blade to the agglomerates for removal thereof.

U.S. Pat. No. 4,669,864 to Shoji et al. discloses a cleaning device arranged on the outer periphery of an image retainer brought into and out of abutment against the image retainer. The cleaning device comprises a first cleaning member, a blade, and a second cleaning member, a brush, arranged downstream of the first cleaning member in the moving direction of the surface of the image retainer.

Briefly stated, and in accordance with one aspect of the present invention, there is provided an apparatus for cleaning the residual materials from an imaging surface, comprising a housing and a holder attached to the housing. The apparatus comprises a primary cleaner, at least partially enclosed in the housing and a resilient blade, having a resiliency ranging from about 20% to about 25%, said blade being located downstream from said primary cleaner, said blade having one end coupled to said holder and a free end opposite thereto, said free end being in pressure contact with the imaging surface having a minimal coefficient of friction therebetween enabling said free end to be in continuous slidable contact with said imaging surface.

Pursuant to another aspect of the present invention, there is provided a cleaning blade in pressure contact with a surface and being adapted to remove particles therefrom, comprising a blade body including a polymeric material having a coefficient of friction less than three and a durometer ranging from about 65 Shore D to 70 Shore D, with a resiliency ranging from about 20% to about 25%, wherein said polymeric material is selected from the group of materials consisting of ultra high molecular weight polyethylenes.

Other features of the present invention will become apparent as the following description proceeds and upon reference to the drawings, in which.

Figure 3:
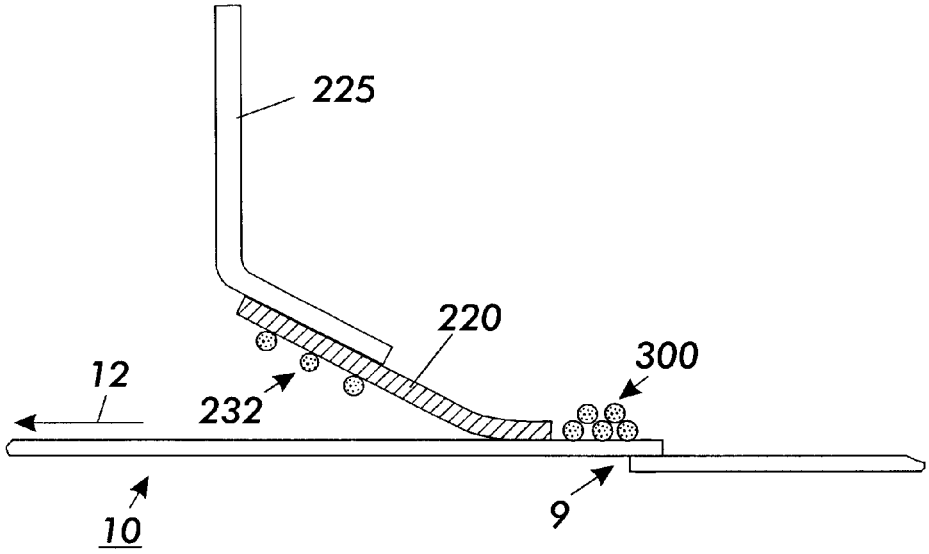
FIG. 3 PRIOR ART
Figure 4:
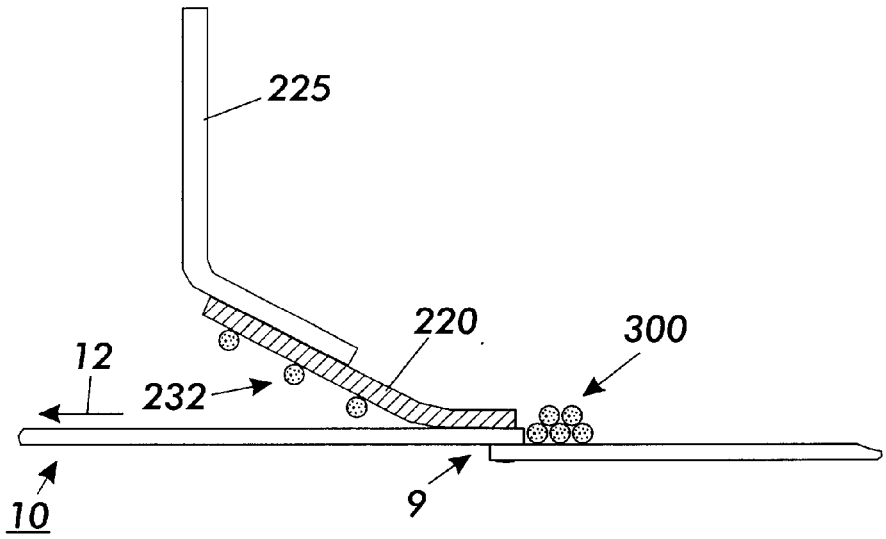
FIG. 4 PRIOR ART
Figure 5:
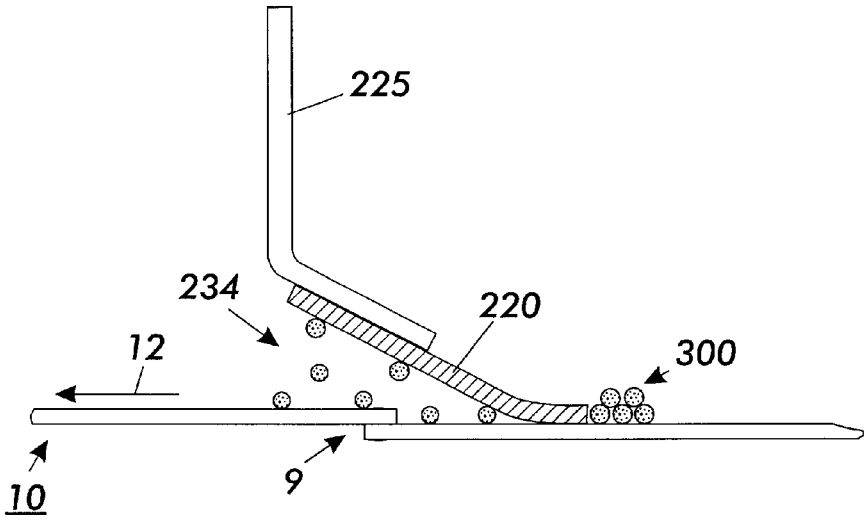
FIG. 5 PRIOR ART
Figure 6:
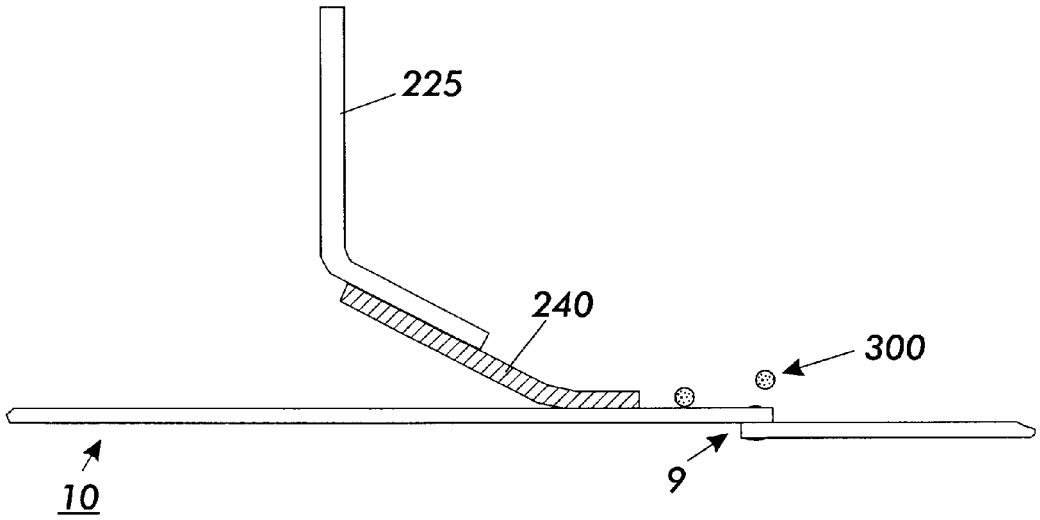

FIGS. 3, 4, and 5 are schematic views of a spots blade illustrating a toner buildup on the back side thereof and subsequent lead edge splatter defect;

FIG. 6 is a schematic view of the blade of the present invention; and

Figure 7:
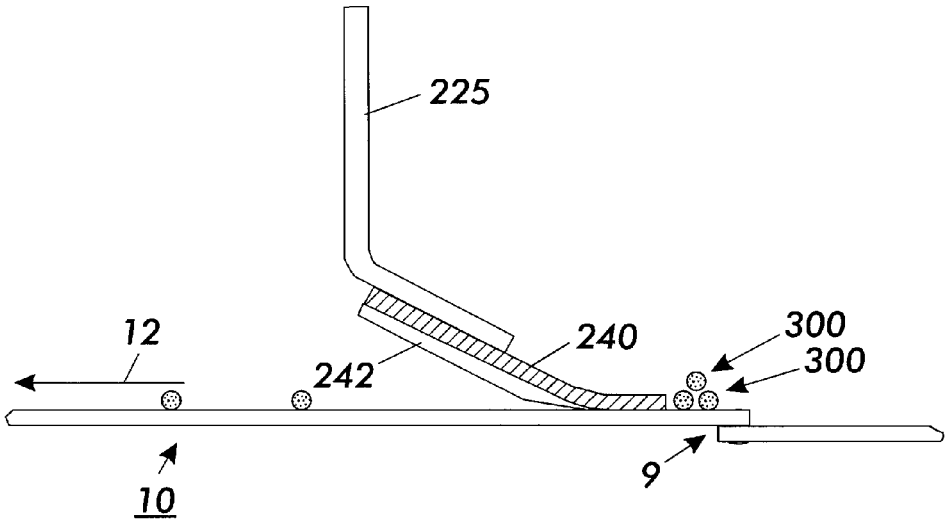
Figure 8:
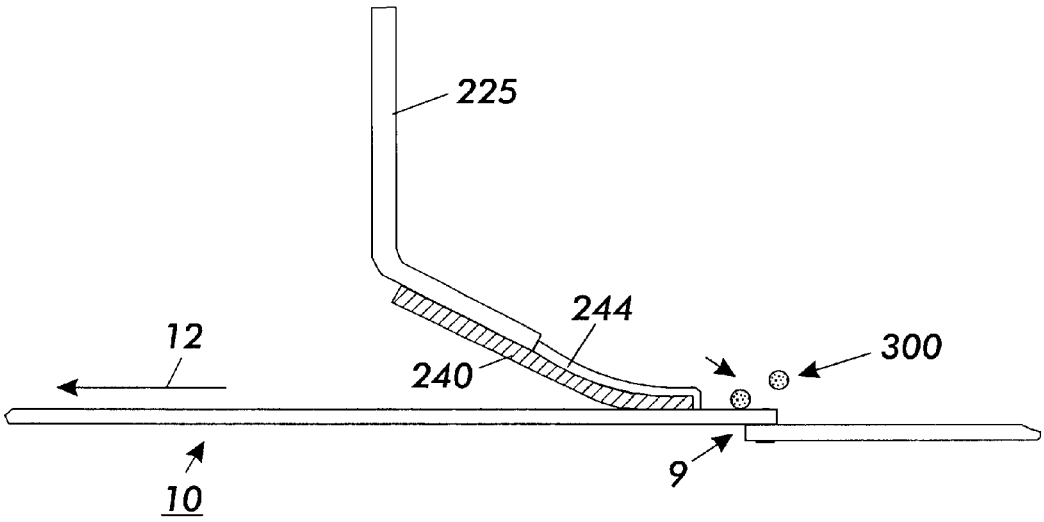

FIGS. 7 and 8 are schematic views of the blade of the present invention including the conductive surfaces thereon.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
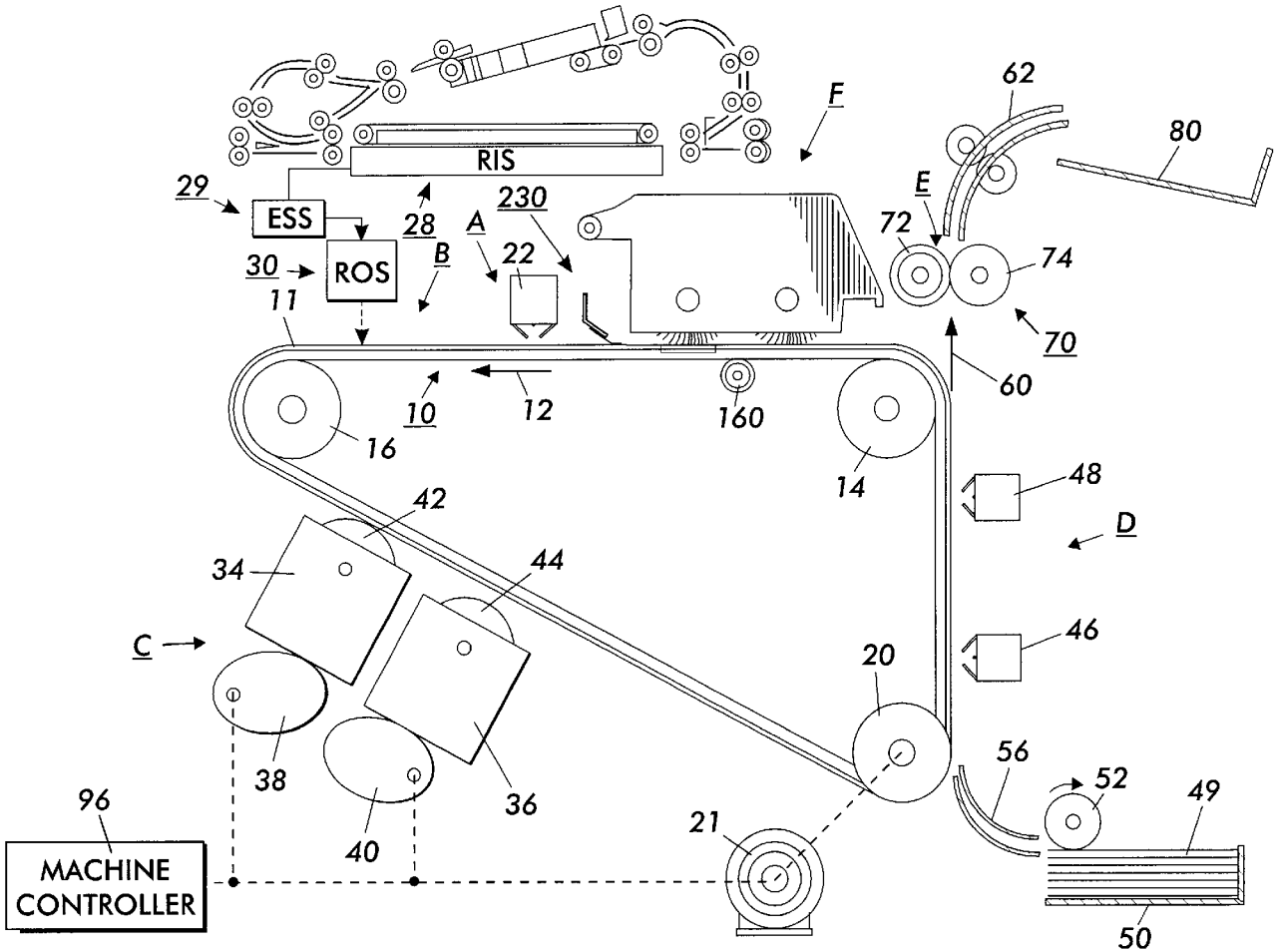
FIG. 1 PRIOR ART
FIG. 1 is a schematic elevational view of a printing apparatus.

For a general understanding of an electrophotographic printer or copier in which the present invention may be incorporated, reference is made to FIG. 1 which depicts schematically the various components thereof. Hereinafter, like reference numerals will be employed throughout to designate identical elements. Although the spots blade of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a raster input scanner RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detach the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheet. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F or stored for disposal. The spots blade cleaning apparatus 230 is located downstream, in the direction of movement of the photoreceptor, from the cleaning station F.

A machine controller 96 is preferably a known programmable controller or combination of controllers, which conventionally control all of the machine steps and functions described above. The controller 96 is responsive to a variety of sensing devices to enhance control of the machine, and also provides connection of diagnostic operations to a user interface (not shown) where required.

Figure 2:
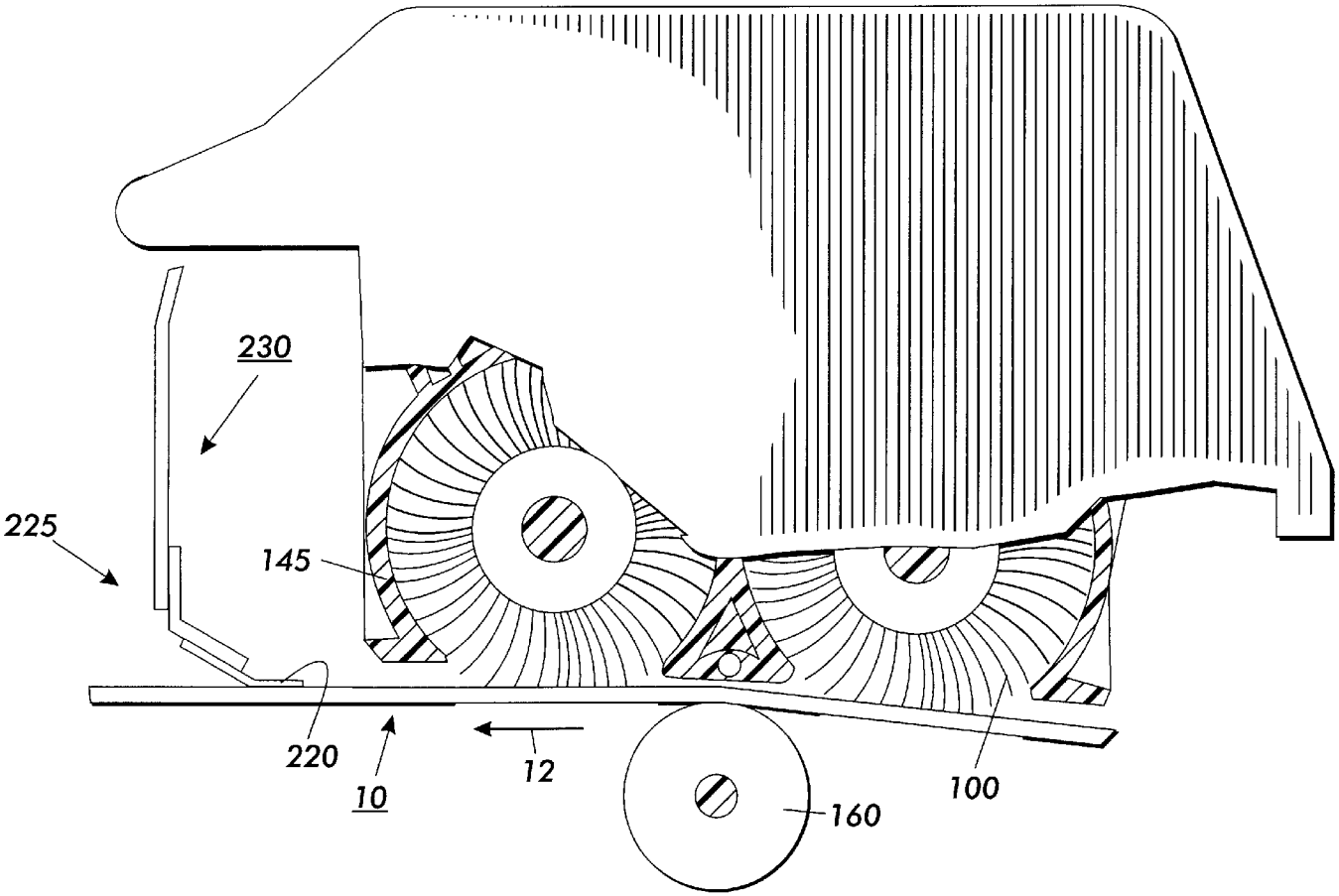
FIG. 2 PRIOR ART
FIG. 2 is a schematic view of the spots blade located upstream from the primary cleaner.

As thus described, a reproduction machine in accordance with the present invention may be any of several well-known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 and 2 where the showings are for the purpose of illustrating a preferred embodiment of the invention and not for limiting the same cleaning apparatus incorporating the elements.

Reference is now made to FIG. 2, which is a frontal elevational view of the cleaning system and the spots blade assembly 230. The spots blade assembly 230 comprises a holder 225 and a spots disturber blade 220. The spots blade assembly 230 is located downstream, in the direction of movement 12 of the photoreceptor 10, to disturb residual particles not removed by the primary cleaner brushes 100. This spots disturber blade 220 is similar to that used in the Xerox 5090 copier. The spots blade disturber 220 is normally in the doctoring mode to allow a build up of residual particles in front of the spots blade 220 (i.e. between the brush cleaner housing 145 and the spots blade 220). This build up of residual particles is removed by the air flow of a vacuum (not shown). The spots blade material of the present invention combines the mechanical properties of low friction, low resilience and high hardness to provide a continuous slidable contact between the spots blade 220 and the photoreceptor surface. This continuous slidable contact is a result of the mechanical properties and not a lubricant introduced to the cleaning operation.

As an example the cleaner subsystem of the Xerox 180 ppm MICR printer is based on the 4635 MX product. During the product development an image defect was generated consistently in frame one on the seven (7) pitch photoreceptor. The image defect is the result of the following scenario as illustrated in FIGS. 3–5:

1. The polyurethane spots blade 220 is in direct contact with the photoreceptor belt 10.
2. As the photoreceptor belt 10 moves past the spots blade 220, the blade 220 obtains a positive charge via triboelectric charging.
3. The cleaning system used in this product is not 100% effective. The negative bias on the cleaning brush imparts a negative charge on the residual toner 300 on the photoreceptor 10. Therefor negatively charged toner particles 232 arrive in front of the spots blade 220.
4. The interaction of the spots blade 220 to the photoreceptor 10 is such that toner particles 300 form a pile in front of the spots blade 10. The toner particles 300 are allowed to go past the spots blade 230.
5. The toner forms a powder cloud under the spots blade as it moves past.

When this happens the negatively charged particles 232 are attracted to the positive spots blade 220.

6. Toner 232 builds up on the back of the spots blade 220 until a critical depth is accumulated. The interaction of the spots blade 220 with the photoreceptor seam 9 imparts enough energy into the blade to shake free the toner mass 234. MICR toner is also heavier than the Xerox 5090 toner used in other 180 ppm machines due to its increased content of magnetite. The added weight helps to contribute to the toner shaking free.

The toner subsequently falls into the image area and results in a defect known as Lead Edge Splatter.

Additionally, current spots blades 220 used in high volume printers/copiers are made from polyurethane rubber. The blade 220 is mounted in a manner that uses the ability of the rubber to deflect easily to obtain a low working angle relative to the photoreceptor 10. This design is dependent on adjusting the spots blade 220 indirectly to obtain the desired working edge deflection that translates into the edge load and subsequent frictional force against the photoreceptor 10. The drawback is that if the deflection is too great the polyurethane rubber blade will have a high frictional force with respect to the photoreceptor can result in image quality defects.

The present invention reveals the combination of mechanical properties that are ideal for a spots blade, and a material that supplies these mechanical properties. The ideal mechanical properties of a spots blade are low friction (adhesion), low resiliency and high hardness. The ultra high molecular weight polyethylene (UHMWPE) material of the present invention has a low coefficient of friction and a high hardness which enables it to avoid the characteristic of the urethane spots blade material (i.e. Acushnet 107-5) commonly used, that causes the print defects described above. A UHMWPE material that is commercially available and meets the property requirements is Tivar® 1000, available from Poly Hi Solidur, Inc. of Fort Wayne, Ind. In lab testing, UHMWPE material of the mechanical properties of the present invention demonstrated, lower resilience and higher hardness than the 107-5 blade material commonly used. These mechanical properties are the desirable characteristics for a spots blade to alleviate the start-up and the blade bounce problems that occur with the 107-5 blade material.

The developer accumulates under the blade during the "bounce" and the ones that become lodged under the blade can scratch the photoreceptor and cause blade wear. Thus, the resiliency of the blade can be associated with a mechanical property that enhances scratching of the photoreceptor and a cause of blade wear. Thus, the resiliency of the material should be low to reduce the blade bounce.

Finally, UHMWPE material has a higher hardness than the 107-5 material. The higher durometer of UHMWPE makes the blade stiffer than the 107-5 material, eliminates blade tuck, and reduces blade "bounce". In the 107-5 blade material, the durometer value is about 70 shore A, whereas the durometer of UHMWPE is about 68 Shore D . This difference makes the latter material significantly stiffer and harder than the 107-5. Higher durometer urethanes generally exhibit much lower frictional properties, and it is the high hardness and lower friction that reduces the adhesion of the blade to the photoreceptor, thereby, eliminating the foldover start-up problem and intermittent blade bounce when the machine is making copies.

As previously indicated the current spots blade 220 causes toner to pile up in front of the spots blade 220. This is due to the relatively high coefficient of friction between the spots blade and the moving photoreceptor belt. As seen in FIG. 6, by incorporating a low friction surface at the photoreceptor/spots blade interface, the piling residual toner 300 in front of the spots blade 240 is minimized and virtually eliminated. The result is that the blade 240 continues to eliminate spots on the photoreceptor while allowing the residual toner 300 to pass by. Since the residual toner 300 has little resistance to passing by the spots blade, less energy is imparted and the powder clouding of the residual toner on the backside of the spots blade is minimized. By also choosing an interface material that charges negatively while the photoreceptor is moving past, the minimal amount of clouding of the toner particles, toner 300 is repelled from the spots blade 240 in the invention described herein. The result is the control and elimination of the defect Lead Edge Splatter.

The interface material selected for this application is ultra high molecular weight polyethylene (UHMWPE) that also possesses high wear resistance. However, any material that meets the same functionality requirements can also be used. For example polytetrafluoroethylene is also a good candidate material.

The UHMWPE blade 240 is hard mounted so as to eliminate the need for adjustment. The low working angle is then a result of the position of a semi-rigid blade 240. With minimal deflection of the blade required to achieve contact with the photoreceptor, the working edge load is minimized. UHMWPE has a low coefficient of friction and high wear resistance, both of which are desirable requirements, that further enhance the reduction of the frictional force between the spots blade 240 and the photoreceptor 10.

As shown in FIGS. 7 and 8, by incorporating an electrically conductive surface to the back 242 or front 244 side of the spots blade 240, the lead edge surface potential can be controlled. For some applications, a negative direct current bias or an electrically grounded potential on the surface prevents lead edge splatter from occurring. The conductive surface can also have a positive direct current or an alternating current potential applied to it to accommodate other machines depending on the residual toner charge. This allows a full range of control of the electric potential on the backside of the spots blade 240 and thereby controlling the toner 300. Particles are suppressed by electric potential or allowed to obtain a neutral potential by contact with a grounded surface. All instances prevent toner 300 from accumulating enough depth to shake free when the belt seam 9 contacts the spots blade 240 and prevents lead edge splatter from occurring.

In recapitulation, the present invention is a blade material having the combined mechanical properties of low friction, low resiliency and high hardness. Additionally, the blade may be made electrically conductive so as to be charged in such a way to repel toner particles. This type of blade material provides a spots blade that avoids the problem of "stick-slip" between the cleaning edge of the blade and the imaging surface. This material provides a continuous sliding motion across the surface being cleaned thus, eliminating tucking and bounce and increasing the blade life.

It is, therefore, apparent that there has been provided in accordance with the present invention, a combination of mechanical properties in a blade material and configuration that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for cleaning residual materials from an imaging surface, comprising:

a housing;

a holder attached to said housing;

a primary cleaner, at least partially enclosed in said housing; and a resilient blade, having a resiliency ranging from about 20% to about 25%, said blade being located doer from said primary cleaner, said blade having one end coupled to said holder and a free end opposite thereto, said free end being in pressure contact with the imaging surface having a very low coefficient of friction therebetween enabling said free end to be in continuous slidable contact with said imaging surfacewherein said blade includes an electrically contact with a moving imaging surface.

2. An apparatus as recited in claim 1, wherein said primary cleaner comprises a brush.

3. An apparatus as recited in claim 1, wherein said blade comprises a polymeric material.

4. An apparatus as recited in claim 3, wherein said polymeric material is selected from the group of materials consisting of ultra high molecular weight polyethylenes.

5. An apparatus as recited in claim 4, wherein said blade has a durometer value ranging from about 65 Shore D to about 70 Shore D

6. An apparatus as recited in claim 1, said electrical conductive surface being charged to a positive potential to repel toner particles.

7. An apparatus as recited in claim 1, said electrially conductive surface being charged to a negative potential to repel toner particles.

8. An apparatus for cleaning residual materials from an imaging surface, comprising:

a housing;

a holder attached to said housing; a brush cleaner, at least partially enclosed in said housing; and a blade cleaner, having a resiliency ranging from about 20% to about 25%, located upstream, in the direction of movement of the photoreceptor, from said brush cleaner, said blade cleaner having one end coupled to said holder and a free end opposite thereto, said free end being in pressure contact with the imaging surface having a very low coefficient of friction therebetween enabling said free end to be in continuous slidable contact with said imaging surface, said blade cleaner being an elastomeric material selected from the group of materials consisting of ultra high molecular weight polyethylenes wherein said blade cleaner includes an electically conductive surface said electrically conductive surface being charged by frictional contact with said imaging surface.

9. A cleaning blade in pressure contact with a surface to be cleaned and being adapted to remove particles therefrom, comprising a blade body including a polymeric material having a coefficient of friction less than three and a durometer value ranging from about 65 Shore D to about 70 Shore D, with a resiliency ranging from about 20% to about 25%, wherein said polymeric material is selected from the group of materials consisting of ultra high molecular weight polyethylenes, and wherein said cleaning blade includes an electrically conductive surface said electrically conductive surface being charged by frictional contact with said surface to be cleaned.

10. A cleaning blade as recited in claim 9, said electrically conductive surface being charged to a positive potential to repel toner particles.

11. A cleaning blade as recited in claim 9, said electrically live surface being charged to a negative potential to repel toner particles.

* * * * *